United States Patent [19]

Olsen

[11] 4,373,824

[45] Feb. 15, 1983

[54] RIBBON TENSION AND METERING CONTROL

[75] Inventor: Alf J. Olsen, Elk Grove Village, Ill.

[73] Assignee: Xerox Corporation, Stamford, Conn.

[21] Appl. No.: 276,064

[22] Filed: Jun. 22, 1981

[51] Int. Cl.[3] ..... B41J 33/52

[52] U.S. Cl. ..... 400/234; 400/208; 242/75.43; 226/195

[58] Field of Search ..... 400/234; 226/195; 242/75.43

[56] References Cited

U.S. PATENT DOCUMENTS

| | | | |
|---|---|---|---|
| 3,349,887 | 10/1967 | Goff, Jr. | 197/151 |
| 3,442,366 | 5/1969 | Spears | 400/234 |
| 3,731,781 | 5/1973 | Caudill et al. | 197/151 |
| 3,877,561 | 4/1975 | Guerrini et al. | 197/151 |
| 4,010,839 | 3/1977 | Guerrini et al. | 400/207 |
| 4,022,401 | 5/1977 | Kishi | 242/198 |
| 4,074,799 | 2/1978 | Hishida et al. | 197/151 |

OTHER PUBLICATIONS

IBM Technical Disclosure Bulletin, vol. 18, No. 4, Sep. 1975, "Ribbon Drag Wire", E. J. Lenney p. 1093.

IBM Technical Disclosure Bulletin, vol. 23, No. 5, Oct. 1980, "Constant-Tension Ribbon Cartridge", pp. 1741-1742.

*Primary Examiner*—Paul T. Sewell

*Assistant Examiner*—Daniel J. Roock

*Attorney, Agent, or Firm*—Richard A. Tomlin

[57] ABSTRACT

Ribbon feed from a ribbon supply spool is controlled in an incrementing ribbon feed system by a pawl and ratchet brake device actuated by ribbon tension. The mechanism utilizes a single-band spring member to control ribbon tension and ribbon metering.

2 Claims, 4 Drawing Figures

RIBBON TENSION AND METERING CONTROL

This invention relates to an ink ribbon cartridge for impact printers and particularly to a mechanism for accurately controlling the metering and tension of an ink ribbon.

As is well known, in high-speed, high-quality impact printers such as electronic typewriters or word processors, very thin ink ribbon materials are used. Thin ribbons are used primarily for space considerations, that is, as a means for providing the maximum length of ribbon for a given spool diameter. As is also well known, ribbon tension control is critical to the operation of impact printers; too much tension can cause these thin ribbons to become misshapen affecting print quality or even cause the ribbon to break. Too low a ribbon tension can cause the ribbon to leave its feeding path causing complete print failure.

The present invention as claimed is intended to provide a remedy. It provides an inexpensive, very simple device for accurately controlling the metering and tensioning of an inked ribbon. The advantage of the present invention is that a single band or leaf spring is used to force the pawl into locking position, to respond to ribbon feed tension by unlocking the pawl and to provide smooth ribbon feed.

One way of carrying out the present invention is described in detail below with reference to the drawing which illustrates only one specific preferred embodiment, in which.

Figure 1B:
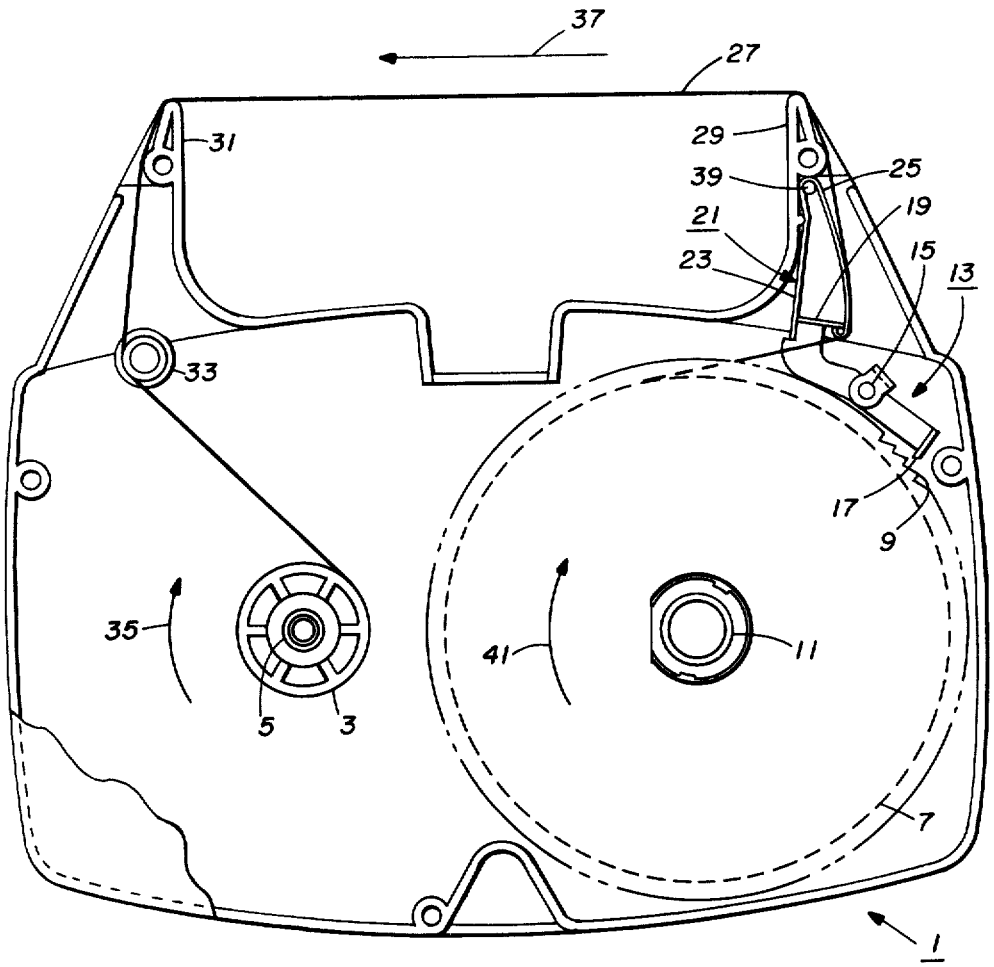
FIG. 1B shows the ribbon tension control and metering device of FIG. 1A but in the ribbon supply spool unlocked position.
Figure 2A:
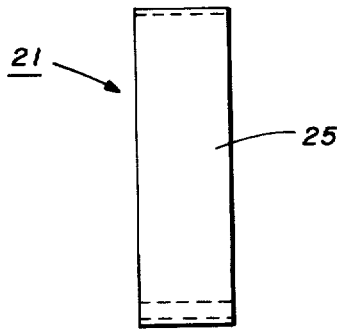
FIGS. 2A and 2B are side and bottom views, respectively, of a preferred ink ribbon tension spring in accordance with the present invention.
Figure 2B:
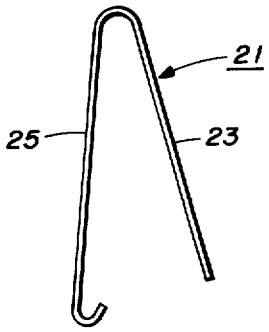

Referring now to the Figures, there is shown an ink ribbon cartridge, designated generally as 1, which contains an ink ribbon take-up spool 3 mounted for rotation on driven shaft 5, and ink ribbon supply spool 7. Ink ribbon supply spool 7 has formed thereon or attached thereto ratchet teeth 9, which encompass an entire perimeter of ink ribbon supply spool 7. Ink ribbon supply spool 7 is mounted for rotation on shaft 11.

Figure 1A:
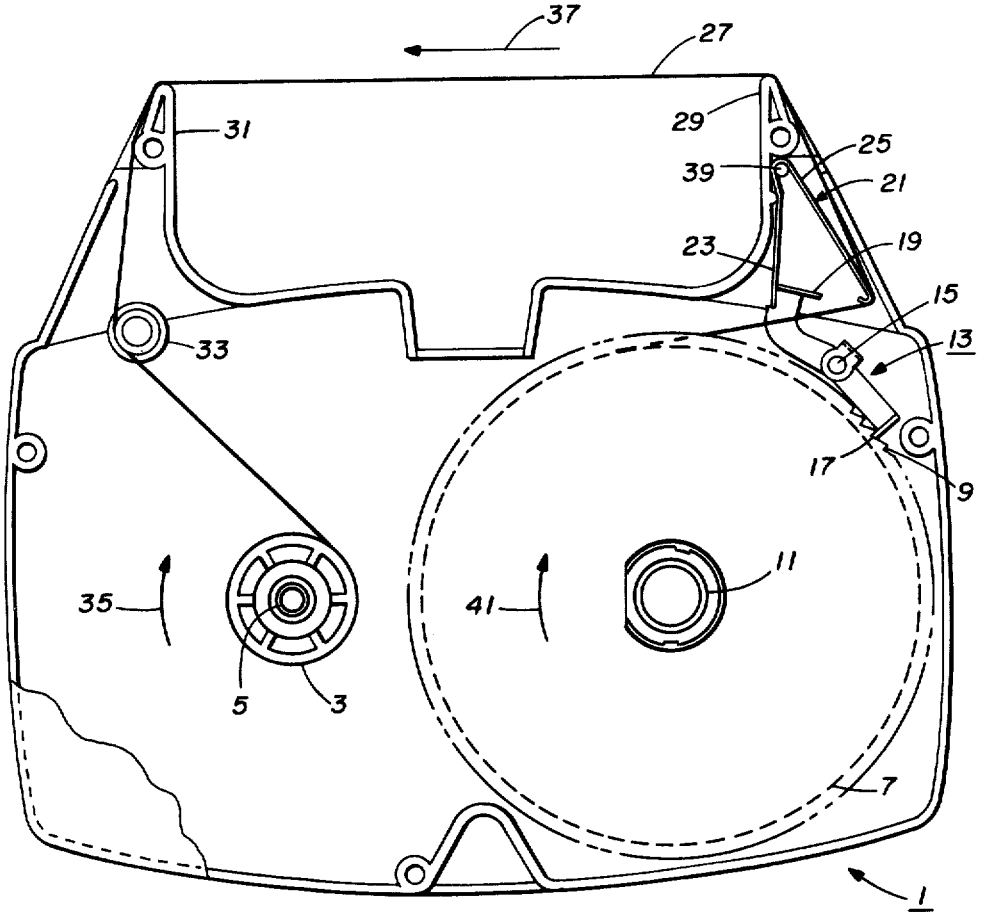
FIG. 1A is a top plan view in partial section of a ribbon cartridge embodying the ribbon tension control and metering device of the present invention.

A pawl, generally designated 13, is mounted for pivotal movement about pin 15. A locking pawl projection 17 on the pawl is designed to fit into ratchet teeth 9 to firmly lock the ink ribbon supply spool 7 against rotation. A second projection 19 is provided to be acted on by the novel ink ribbon tension spring, generally designated 21, of this invention. Ribbon tension spring 21 has a first leg 23 which urges pawl 13 in a clockwise direction as shown in FIGS. 1A and 1B. A second leg 25 is provided which contacts the back of ink ribbon 27 and is designed to contact projection 19 on pawl 13. Ink ribbon 27 is provided on ink ribbon supply spool 7, threaded around ink ribbon tension spring 21, ink ribbon guides 29, 31 and 33, and wound around ink ribbon take-up spool 3.

In operation driven shaft 5, which may be driven by any conventional apparatus known in the art (shaft 5 could be, for example, the drive shaft of a motor not shown), is rotated in the direction shown by arrow 35 a predetermined distance in order to advance ribbon 27 in the direction shown by arrow 37. As ink ribbon take-up spool 3 is rotated by driven shaft 5, ribbon 27 is pulled in the direction shown by arrow 37. This movement causes an increase in ink ribbon tension, which causes leg 25 of ribbon tension spring 21 to pivot clockwise around post 39 toward pawl projection 19. Leaving a predetermined distance between leg 25 and pawl projection 19 provides a stored spring energy function which will maintain constant tension on the ribbon in the event the printing action or relative movement between the ribbon cartridge and printer mounted ribbon guides (not shown) should cause ribbon to be pulled off the supply spool 7 in addition to that demanded by movement of the take-up spool 3. Once the tension in the ink ribbon 27 reaches a level high enough, leg 25 is forced into contact with pawl projection 19 as seen in FIG. 1B. As ribbon tension increases further, leg 25 pushes pawl 13 counterclockwise around pin 15, against the action of leg 23, raising locking pawl projection 17 out of contact with ratchet teeth 9, releasing ink ribbon supply spool 7 for movement in the direction shown by arrow 41. As ink ribbon supply spool 7 moves in the direction shown by arrow 41, ribbon tension decreases allowing leg 25 to move away from pawl projection 19 allowing leg 23 to force the locking pawl projection 17 into contact with ratchet teeth 9, again locking ink ribbon supply spool 7 against further movement.

The ribbon tension spring 21 of this invention is very simple, easy to manufacture and provides a ribbon cartridge which is inexpensive and easy to assemble. Further, the ribbon tension spring 21 provides a positive lock so that when ink ribbon cartridge 1 is removed from a printer mechanism, the ribbon 27 will not unravel from the ink ribbon supply spool. The ribbon tension spring 21 of this invention, although made as a single unit, provides all of the functions of prior art devices utilizing several members. A preferred ribbon tension spring 21 is made of a single band of 0.003 inch type 301 stainless steel having a total length of about two inches and a width of about 0.3 inch.

Although specific embodiments and components have been disclosed above, other ramifications and modifications will occur to those skilled in the art upon reading the above disclosure. For example, although the above discussion was limited to the use of the present invention in connection with ink ribbons, other web materials may be similarly controlled where suitable. Such ramifications and modifications should be considered within the spirit and scope of the present invention and encompassed by the appended claims.

What is claimed is:

1. A web feeding apparatus including means for rotatably supporting a web supply spool and an incrementally operating take-up spool for pulling a web from said supply spool; the improved web tension and metering control comprising:

ratchet teeth mounted on said supply spool;

a pawl mounted adjacent said ratchet teeth and pivotable into locking engagement therewith; and a single member web tension spring having a first leg and a second leg, said first leg mounted for urging said pawl into locking relationship with said ratchet teeth, said second leg mounted such that as the tension in a web in contact with said second leg increases, said second leg is urged into contact with said pawl in opposition to the action of said first leg to raise said pawl out of locking relationship with said ratchet teeth, and said second leg stores spring energy to maintain constant tension on the web.

2. The web feeding apparatus of claim 1 wherein said web tension spring is positioned a predetermined distance from said pawl to eliminate chatter.

* * * * *